US009682308B1

(12) United States Patent
Reinarz

(10) Patent No.: US 9,682,308 B1
(45) Date of Patent: Jun. 20, 2017

(54) SNOWBOARD BINDING AND SNOWBOARD

(71) Applicant: Kelly Reinarz, Snowmass, CO (US)

(72) Inventor: Kelly Reinarz, Snowmass, CO (US)

( * ) Notice: Subject to any disclaimer, the term of this patent is extended or adjusted under 35 U.S.C. 154(b) by 0 days.

(21) Appl. No.: 14/967,989

(22) Filed: Dec. 14, 2015

(51) Int. Cl.

| | |
|---|---|
| ***A63C 9/18*** | (2012.01) |
| ***A63C 10/06*** | (2012.01) |
| ***A63C 5/03*** | (2006.01) |
| ***A63C 10/24*** | (2012.01) |

(52) U.S. Cl.
CPC ..... *A63C 10/06* (2013.01); *A63C 5/03* (2013.01); *A63C 10/24* (2013.01)

(58) Field of Classification Search
CPC ..... A63C 10/06; A63C 5/03; A63C 10/24; A63C 10/00; A63C 10/04
See application file for complete search history.

(56) References Cited

U.S. PATENT DOCUMENTS

| | | | | |
|---|---|---|---|---|
| 5,383,258 | A | 1/1995 | Nicoletti | |
| 5,435,080 | A | 7/1995 | Meiselman | |
| 5,715,582 | A | 2/1998 | Zorzi | |
| 5,857,700 | A * | 1/1999 | Ross | A63C 10/04 280/14.22 |
| 6,390,492 | B1 | 5/2002 | Bumgarner et al. | |
| 6,543,159 | B1 | 4/2003 | Carpenter et al. | |
| 6,554,297 | B2 | 4/2003 | Phillips et al. | |
| 7,011,333 | B2 * | 3/2006 | Pascal | A63C 10/06 24/71 SK |
| 7,306,241 | B2 * | 12/2007 | Cunningham | A43C 11/1466 280/14.22 |
| 7,516,976 | B2 * | 4/2009 | Cunningham | A43C 11/146 280/11.36 |
| 8,696,013 | B2 * | 4/2014 | Saunders | A63C 10/045 280/623 |
| 2003/0005556 | A1 | 1/2003 | Gallina | |
| 2007/0175067 | A1 * | 8/2007 | Pascal | A43C 11/1473 36/50.5 |
| 2015/0021881 | A1 * | 1/2015 | Hutchison | A63C 10/06 280/621 |

FOREIGN PATENT DOCUMENTS

| | | |
|---|---|---|
| WO | 0076337 | 12/2000 |

OTHER PUBLICATIONS

International Search Report and Written Opinion of international application No. PCT/US2016/066584, dated Apr. 13, 2017, 7 pages provided.

* cited by examiner

*Primary Examiner* — Brian Swenson
(74) *Attorney, Agent, or Firm* — Hamre, Schumann, Mueller & Larson, P.C.

(57) ABSTRACT

A snowboard binding that eliminates the ratchet-type connection used in conventional snowboard bindings. Instead, the snowboard binding incorporates a connection mechanism that is somewhat similar to a ski-boot style connector, and that uses only two straps on each binding compared to the traditional four straps. In addition, the connection mechanism can be pre-adjusted by the user to the desired connection pressure. Once the desired pre-adjustment is reached, the user can simply step into the binding and connect the connection mechanism without needing to adjust the connection pressure or tightness during mounting the user's foot or boot to the board as with conventional snowboard bindings.

18 Claims, 12 Drawing Sheets

SNOWBOARD BINDING AND SNOWBOARD

FIELD

The present described embodiments relate to a snowboard binding and a snowboard.

BACKGROUND

A snowboard binding is used in order to bind the snowboard rider's boot to the snowboard. In some snowboard bindings, to hold the rider's boot to the snowboard binding, an ankle cap assembly and a toe cap assembly are provided. The ankle cap assembly and the toe cap assembly each include two straps that are releasably connected to one another by a ratchet mechanism fixed to one of the straps. The ratchet mechanism engages with the other strap, called a ladder strap, which includes ladder-type teeth thereon that function with the ratchet mechanism to permit adjustment of the connection pressure of the respective ankle cap assembly and the toe cap assembly by actuating the ratchet mechanism back and forth.

Strapping into current binding technology can be difficult. The user is required to step through and around the straps, or use their hands to move aside the straps just to get a boot into the base or frame of the binding. Depending on the user's snowboarding skill level, this part of the process could force a beginner to have to sit down on a bench or directly on the snow in order to maneuver their boot into the binding. Once the boot is positioned in the binding, the user then has to use both hands to feed the ladder strap through the ratchet mechanism, which could be full of snow and/or ice, and then the user actuates the ratchet mechanism to tighten the straps with hopes of achieving correct tightness. If the straps are too loose, the user's boot slides around inside of the binding frame; if the straps are too tight, circulation to the user's feet can be cut off. These problems are increased by the fact that a user is required to disconnect one boot from a binding each time when riding a chairlift to the top of the mountain (or disconnecting both boots when riding a gondola) so that the user must reconnect their boot to the binding each time after exiting the chairlift.

SUMMARY

A snowboard binding and a snowboard that incorporates a pair of the snowboard bindings are described. The snowboard binding eliminates the ratchet-type connection used in conventional snowboard bindings. Instead, the snowboard binding incorporates a connection mechanism that is somewhat similar to a ski-boot style connector, and that uses only two straps on each binding compared to the traditional four straps. In addition, the connection mechanism can be pre-adjusted by the user to the desired connection pressure. Once the desired pre-adjustment is reached, the user can simply step into the binding and connect the connection mechanism without needing to adjust the connection pressure or tightness during mounting of the user's foot or boot to the board as is required with conventional snowboard bindings.

In accordance with one described embodiment, a snowboard binding is provided that includes a binding frame; an ankle cap connected to the binding frame; a first buckle attached to the ankle cap; a first engagement member connected to the first buckle; a first binding hook directly attached to the binding frame and releasably engageable with the first engagement member; a toe cap connected to the binding frame; a second buckle attached to the toe cap; a second engagement member connected to the second buckle; and a second binding hook directly attached to the binding frame and releasably engageable with the second engagement member.

In accordance with another described embodiment, a snowboard binding is provided that includes a binding frame; an ankle cap connected to the binding frame; an ankle cap strap attached to the binding frame and to the ankle cap; and an ankle cap buckle mechanism connecting the ankle cap and the binding frame. The ankle cap buckle mechanism includes a first buckle, a first engagement member, and a first binding hook. The first buckle and the first engagement member are mounted on the ankle cap, and the first binding hook is mounted on the binding frame and is releasably engageable with the first engagement member. The binding also includes a toe cap connected to the binding frame; a toe cap strap attached to the binding frame and to the toe cap; and a toe cap buckle mechanism connecting the ankle cap and the binding frame. The toe cap buckle mechanism includes a second buckle, a second engagement member, and a second binding hook. The second buckle and the second engagement member are mounted on the toe cap, and the second binding hook is mounted on the binding frame and is releasably engageable with the second engagement member.

In accordance with still another described embodiment, a snowboard binding is provided that includes a binding frame means; an ankle cap assembly that includes an ankle cap means connected to the binding frame means, a first buckle means attached to the ankle cap means, a first engagement means connected to the first buckle means, and a first binding hook means that is releasably engageable with the first engagement means. The first binding hook means is mounted directly on an outwardly facing side surface of the binding frame means. The binding also includes a toe cap assembly that includes a toe cap means connected to the binding frame means, a second buckle means attached to the toe cap means, a second engagement means connected to the second buckle means, and a second binding hook means that is releasably engageable with the second engagement means. The second binding hook means is mounted directly on the outwardly facing surface of the binding frame means.

In accordance with another described embodiment, a snowboard is provided. The snowboard comprises: two of the snowboard bindings described herein and a snowboard body. The snowboard body comprises an upper surface and a lower surface. The upper surface and the lower surface are opposite each other. The snowboard bindings are attached to the upper surface.

DRAWINGS

DETAILED DESCRIPTION

Figure 1:
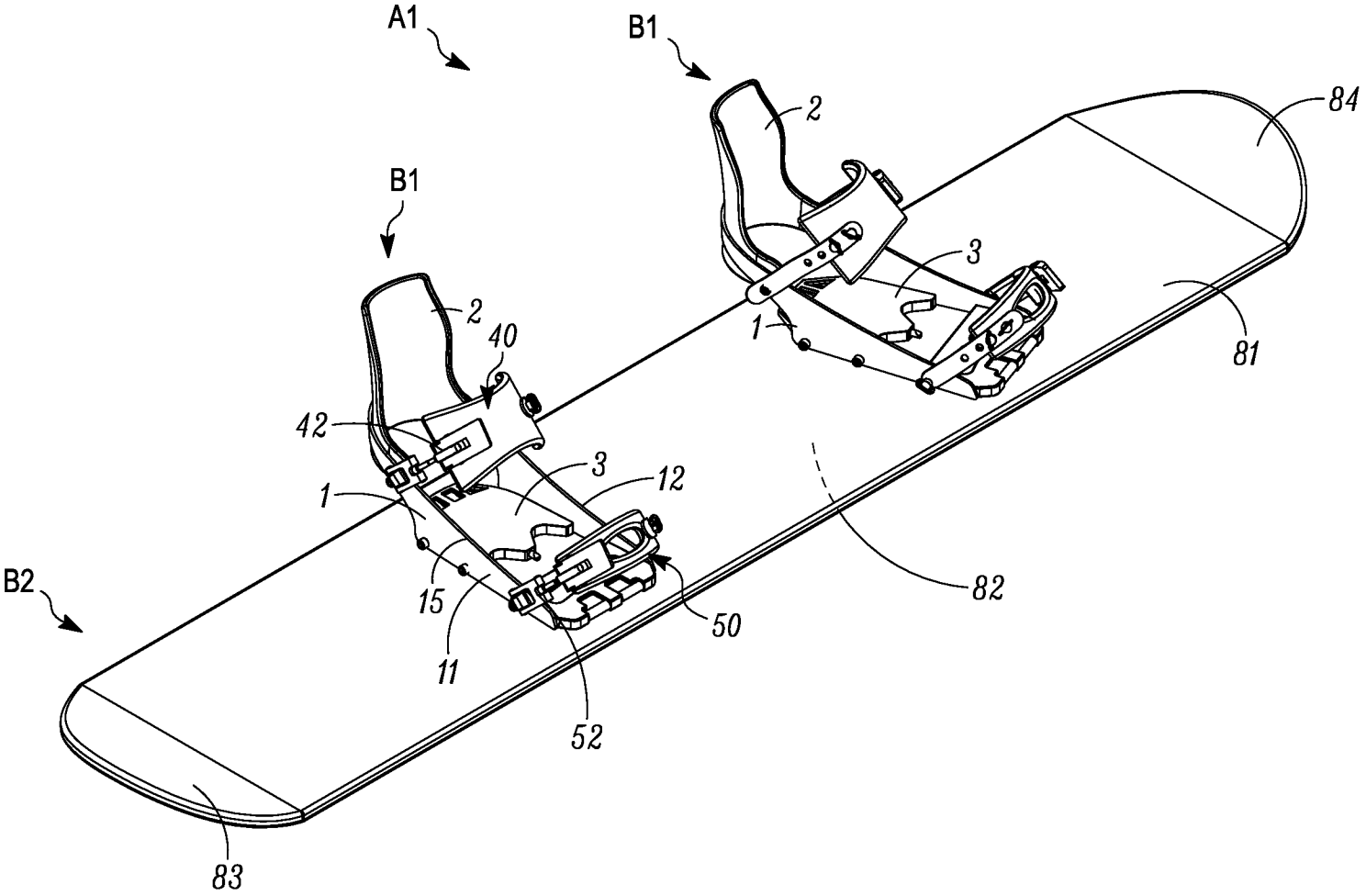
FIG. 1 is a perspective view of a snowboard according to one embodiment.

FIG. 1 is a perspective view of a snowboard according to one embodiment. As shown in FIG. 1, the snowboard A1 comprises two snowboard bindings B1 and a snowboard body B2. Each snowboard binding B1 is attached to the snowboard body B2. Each snowboard binding B1 is for binding a snowboard rider's boots (not shown) to the snowboard body B2.

Figure 2:
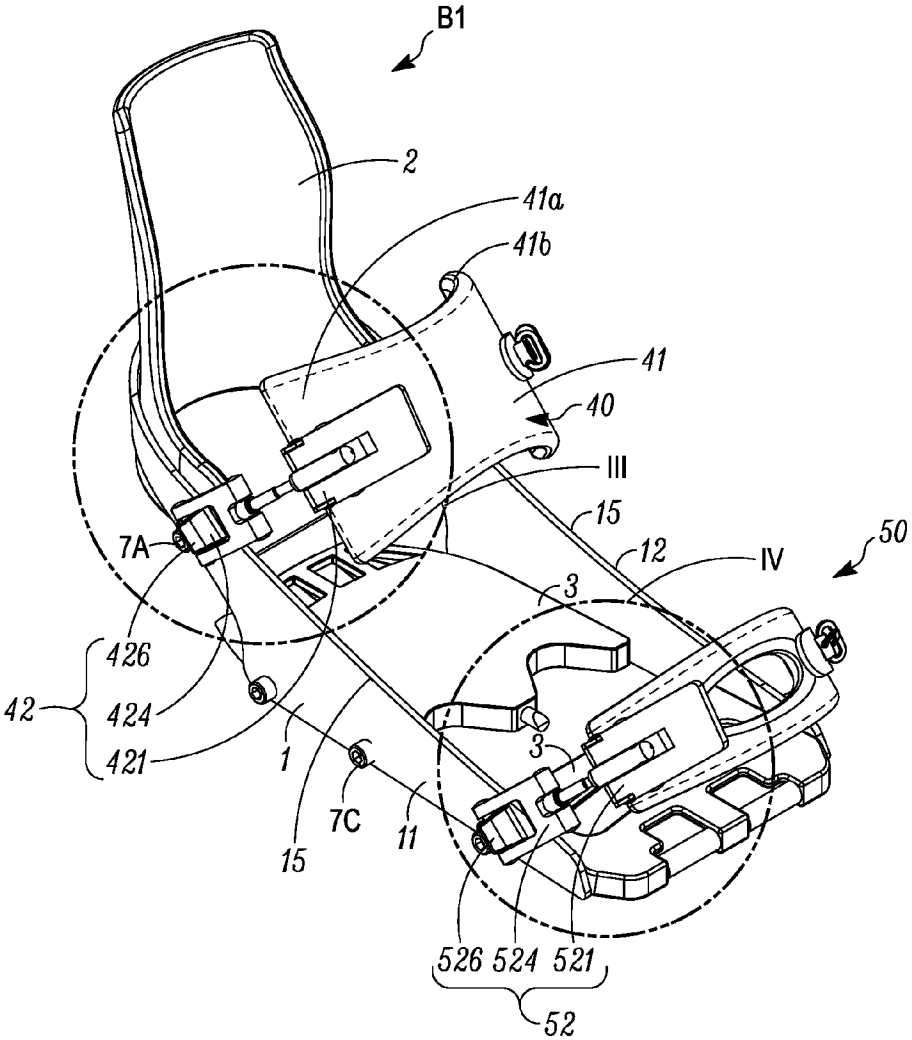
FIG. 2 is a front perspective view showing one of the snowboard bindings shown in FIG. 1.
Figure 4:
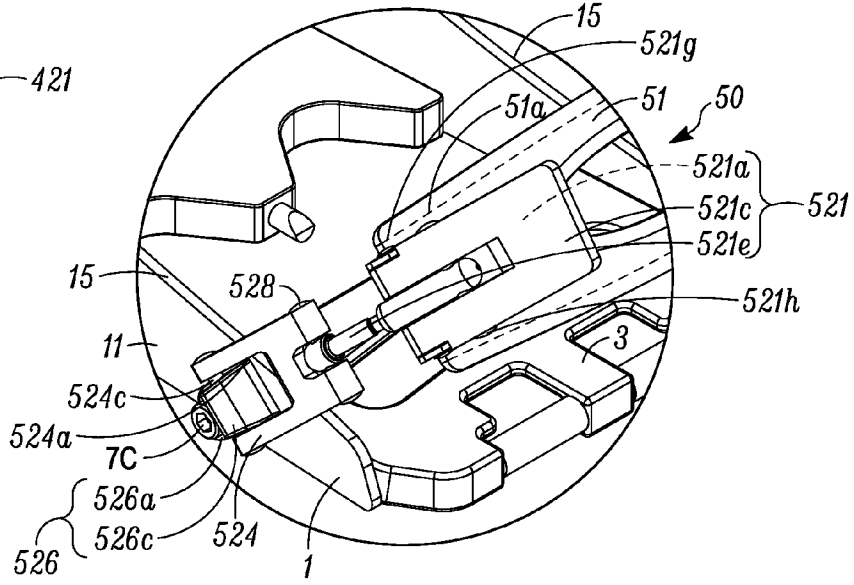
FIG. 4 is an enlarged perspective view of the region IV in FIG. 2.
Figure 3:
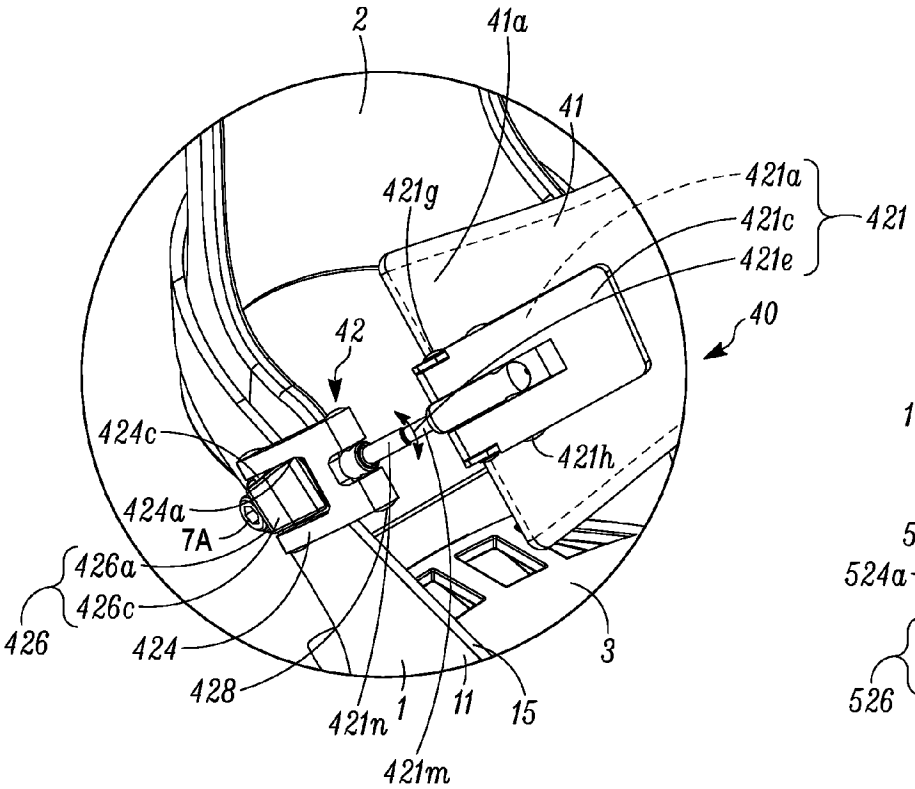
FIG. 3 is an enlarged perspective view of the region III in FIG. 2.
Figure 5:
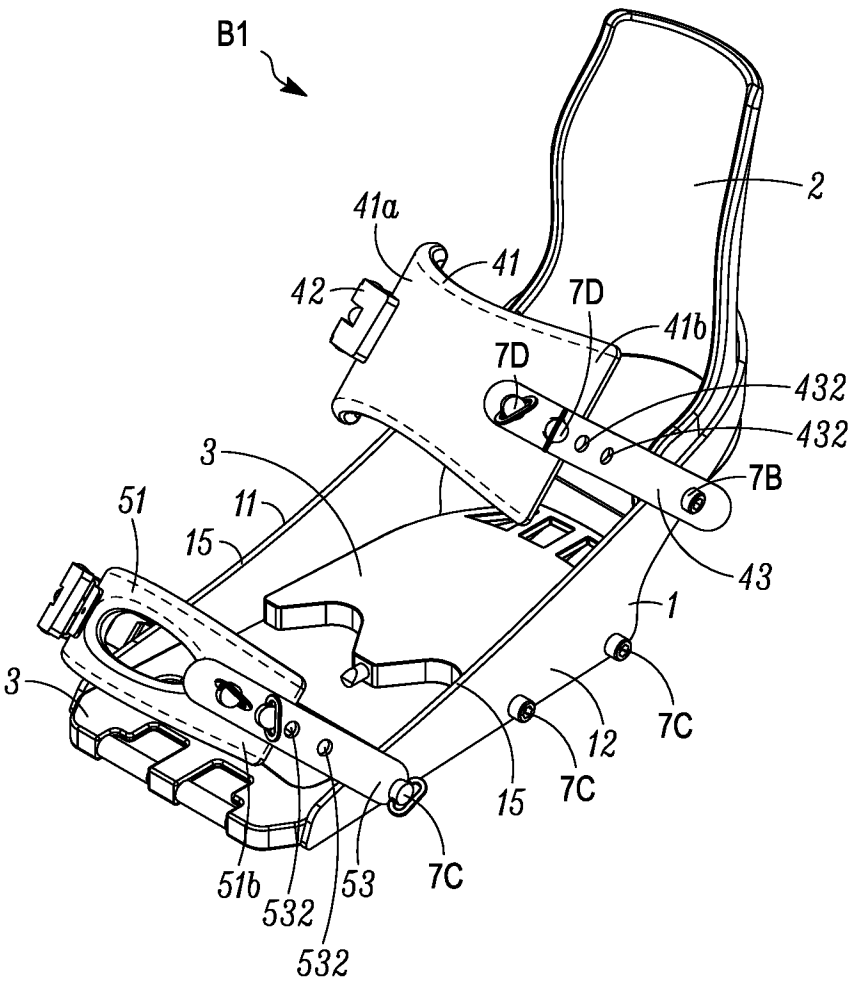
FIG. 5 is another front perspective view showing the snowboard binding shown in FIG. 2.
Figure 6:
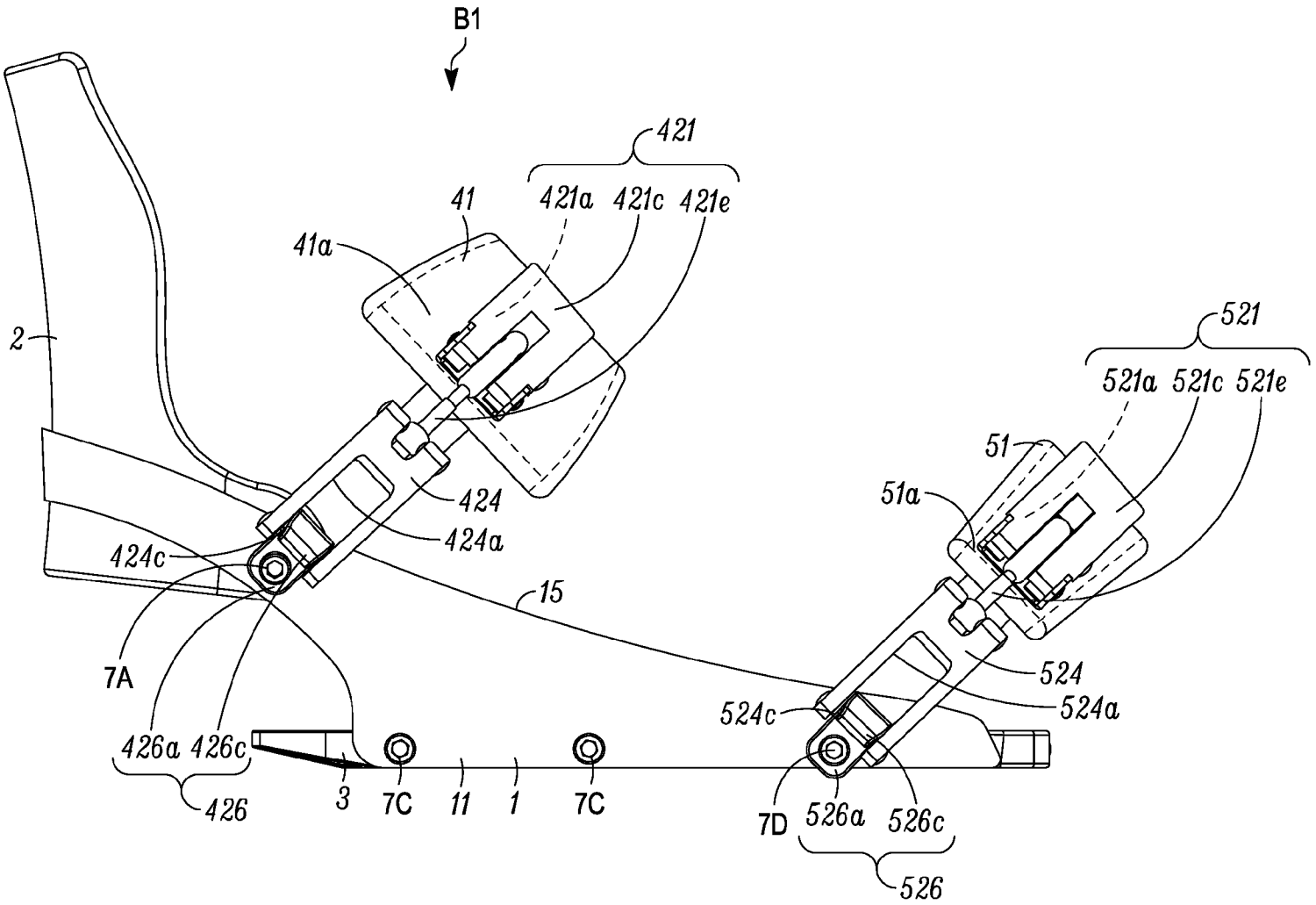
FIG. 6 is a left side view showing the snowboard binding shown in FIG. 2.

FIG. 2 is a front perspective view showing one of the snowboard bindings B1 shown in FIG. 1. FIG. 3 is an enlarged perspective view of the region III in FIG. 2. FIG. 4 is an enlarged perspective view of the region IV in FIG. 2. FIG. 5 is another front perspective view showing the snowboard binding shown in FIG. 2. FIG. 6 is a left side view showing the snowboard binding shown in FIG. 2.

As shown in these figures, each snowboard binding B1 includes a binding frame 1 (also referred to as a binding frame means), a highback 2 (which can be considered part of the binding frame 1), a base plate 3, an ankle cap assembly 40 with an ankle cap 41 (also referred to as an ankle cap means), an ankle cap buckle mechanism 42, an ankle cap strap 43, a toe cap assembly 50 with a toe cap 51 (also referred to as a toe cap means), a toe cap buckle mechanism 52, a toe cap strap 53, and attaching members 7A, 7B.

Figure 8:
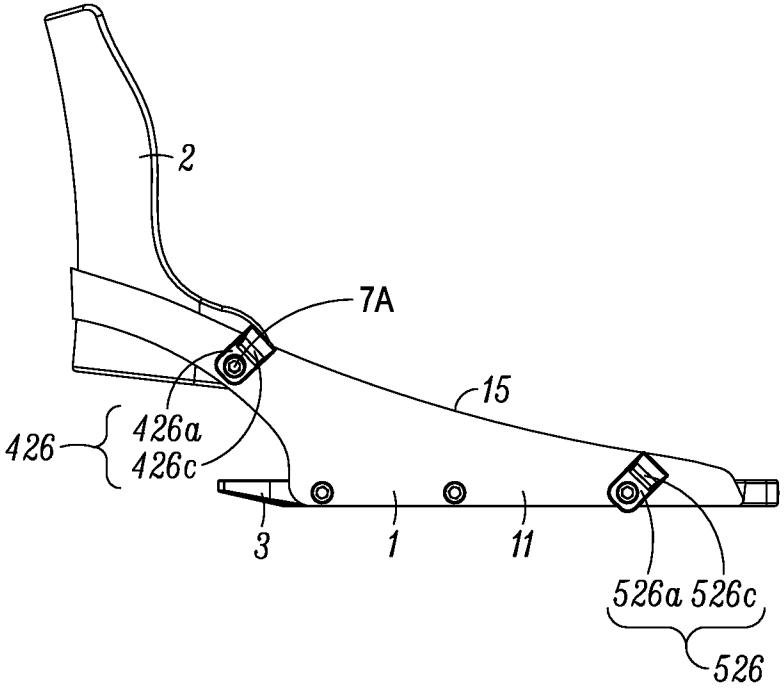
FIG. 8 is a left side view showing the snowboard binding shown in FIG. 7.
Figure 7:
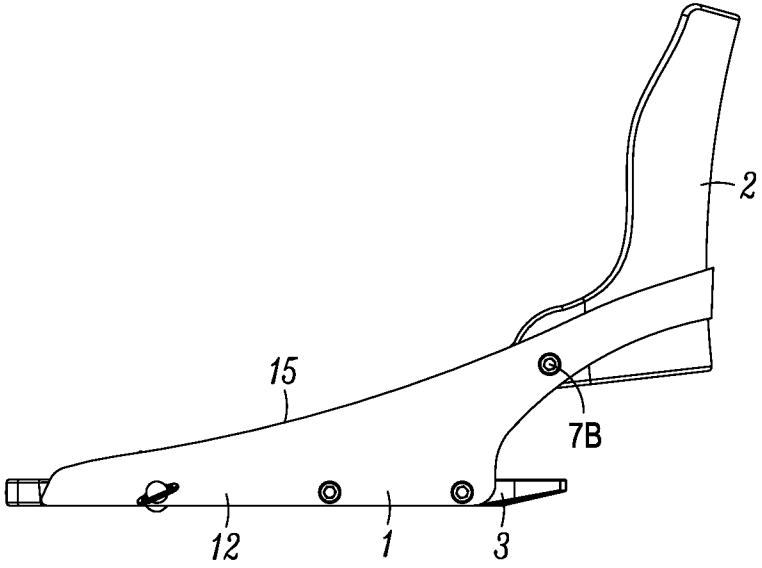
FIG. 7 is a right side view showing the snowboard binding shown in FIG. 2 (illustration of several parts omitted).
Figure 9:
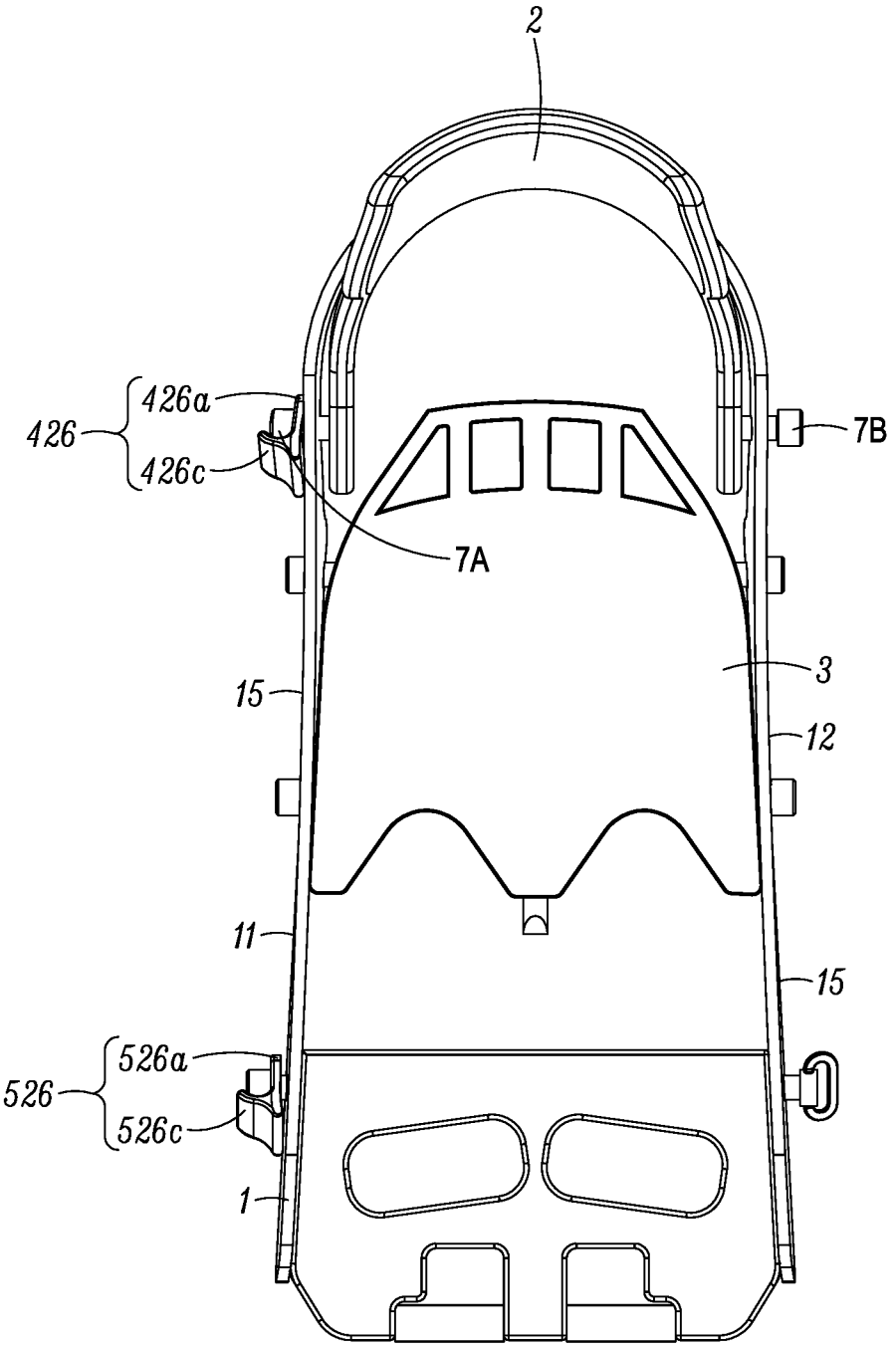
FIG. 9 is a top view showing the snowboard binding shown in FIG. 7.
Figure 10:
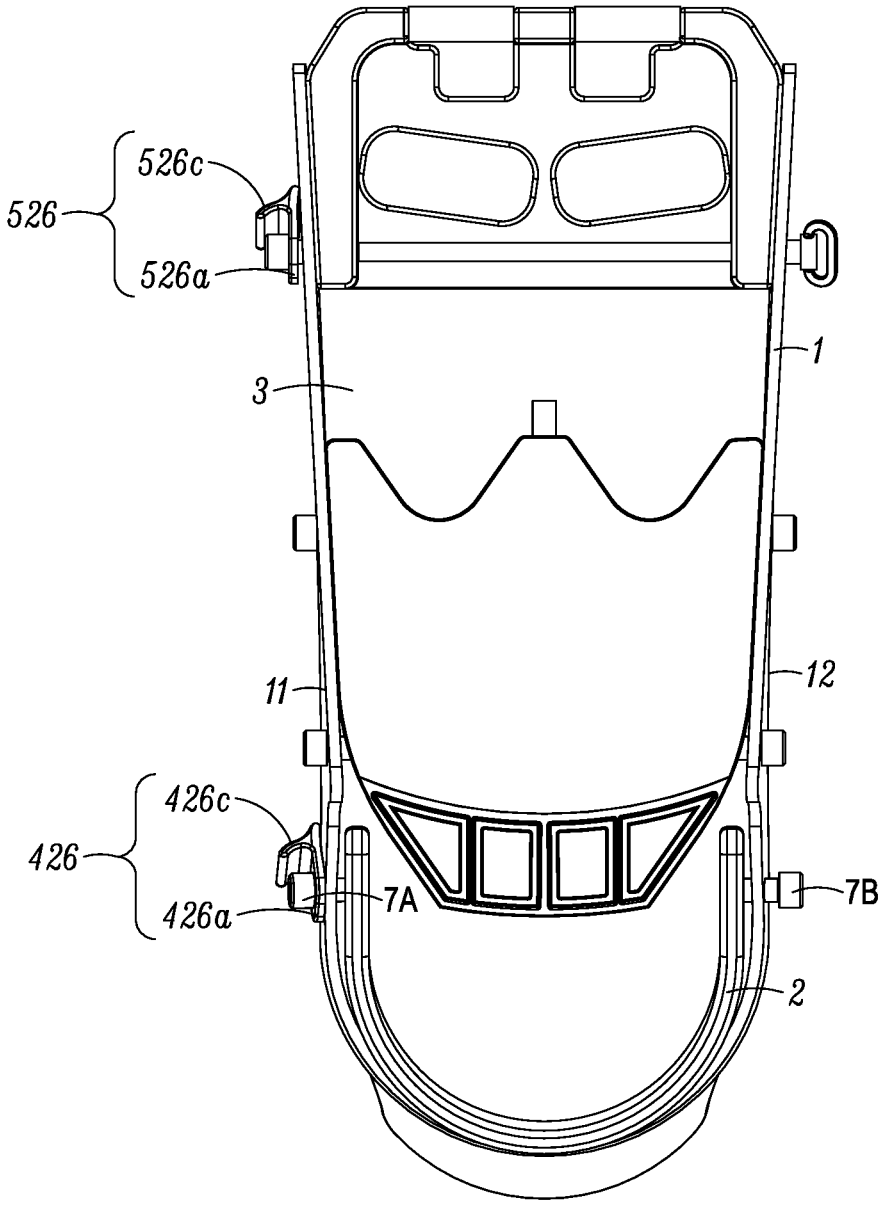
FIG. 10 is a bottom view showing the snowboard binding shown in FIG. 7.
Figure 12:
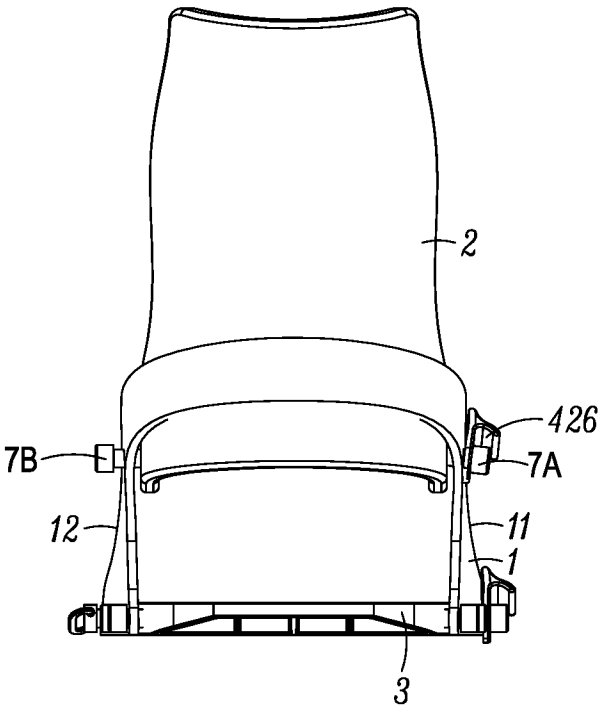
FIG. 12 is a rear view showing the snowboard binding shown in FIG. 7.
Figure 11:
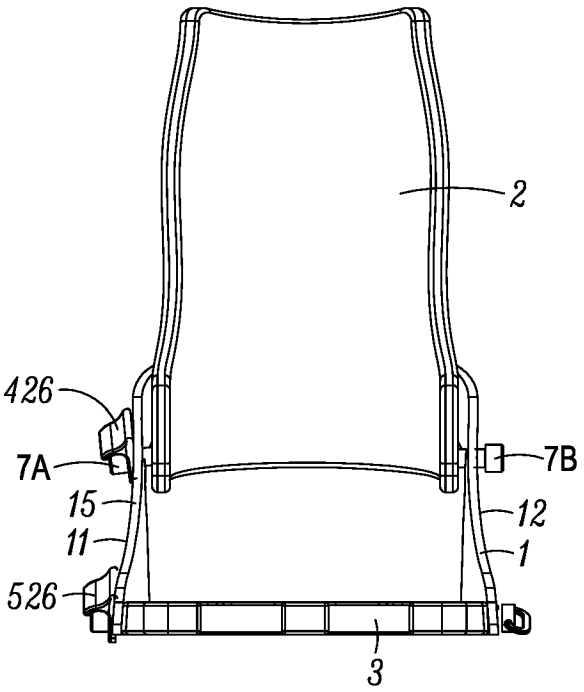
FIG. 11 is a front view showing the snowboard binding shown in FIG. 7.

FIG. 7 is a right side view showing the snowboard binding shown in FIG. 2. FIG. 8 is a left side view showing the snowboard binding shown in FIG. 7. FIG. 9 is a top view showing the snowboard binding shown in FIG. 7. FIG. 10 is a bottom view showing the snowboard binding shown in FIG. 7. FIG. 11 is a front view showing the snowboard binding shown in FIG. 7. FIG. 12 is a rear view showing the snowboard binding shown in FIG. 7. In these figures, illustration of the ankle cap 41, parts of the ankle cap buckle mechanism 42, the ankle cap strap 43, the toe cap 51, parts of the toe cap buckle mechanism 52, and the toe cap strap 53 are omitted.

As shown in FIG. 1, the binding frame 1 is attached to the snowboard body B2. The binding frame 1 can be made of, but not limited to, metal or plastic. As shown in FIGS. 2, 5, 6, and 9, the binding frame 1 includes a first outwardly facing side surface 11 and a second outwardly facing side surface 12. The side surfaces 11, 12 face in opposite directions. As shown in FIG. 9, the first side surface 11 and the second side surface 12 face outwardly when the binding B1 is viewed in a top view. As shown in FIGS. 2, 5, and 6, the binding frame 1 also includes upper edges 15. In the illustrated embodiment, one of the upper edges 15 is located at the upper end of the first side surface 11, and another of the upper edges 15 is located at the upper end of the first side surface 12.

With reference to FIGS. 2, 5, and 6, the highback 2 is pivotally attached to the binding frame 1 by the attaching members 7A, 7B. Examples of suitable attaching members 7A, 7B can include, but are not limited to, screws, bolts, or the like. The highback 2 is foldable relative to the binding frame 1 between an upright position (shown in the figures) and a folded position (not shown) as in conventional snowboard bindings. When the highback 2 is in the upright position, the highback 2 comes into contact with the rear part of the snowboard rider's boot when the snowboard A1 is used. The highback 2 can be made of, but not limited to, metal or plastic.

As shown in FIGS. 2, and 5, the base plate 3 is attached to the binding frame 1, and the base plate 3 is attached to the snowboard body B2 for mounting the bindings B1 to the snowboard body B2. In addition, the base plate 3 helps to keep the sides of the frame 1 spaced apart, and supports the snowboard rider's boots when the snowboard A1 is used. The base plate 3 can be made of, but not limited to, metal or plastic. In the illustrated example, the base plate 3 includes two parts separated each other. Each of these parts is attached to the binding frame 1 by attaching members 7C. The attaching members 7C can be, but are not limited to, screws, bolts, or the like.

With reference to FIGS. 2, 3, 5, and 6, the ankle cap 41 is connected to the binding frame 1. The ankle cap 41 helps to hold the snowboard rider's boot to the binding frame 1. The ankle cap 41 includes a first end portion 41*a* and a second end portion 41*b*. In the illustrated embodiment, the first end portion 41*a* is disposed at one end of the ankle cap 41 in a width direction of the binding frame 1. The second end portion 41*b* is disposed at the other end of the ankle cap 41 in the width direction.

The ankle cap buckle mechanism 42 connects the ankle cap 41 to one side of the binding frame 1. In the illustrated example, the ankle cap buckle mechanism 42 is attached to the first end portion 41*a* of the ankle cap 41, and is releasably attachable to the first side surface 11 of the binding frame 1. The ankle cap buckle mechanism 42 can have two primary conditions—a connected condition and a disconnected condition. When the ankle cap buckle mechanism 42 is in the connected condition, the ankle cap 41 and the binding frame 1 are connected by the ankle cap buckle mechanism 42 (see FIGS. 2, 5, and 6). On the other hand, when the ankle cap buckle mechanism 42 is in the disconnected condition, the ankle cap 41 and the binding frame 1 are not connected by the ankle cap buckle mechanism 42 (see FIG. 14).

As shown in FIGS. 2, 5, and 6, the ankle cap buckle mechanism 42 includes a first buckle 421 (also referred to as a first buckle means), a first engagement member 424 (also referred to as a first engagement means), and a first binding hook 426 (also referred to as a first engagement means).

The first buckle 421 is attached to the ankle cap 41. Specifically, the first buckle 421 is attached to the first end portion 41*a* of the ankle cap 41. The first buckle 421 can be made of metal, plastic, or other suitable material. The first buckle 421 includes a support base 421*a*, a lever 421*c*, and a traction element 421*e*.

As shown in FIGS. 3, and 6, the support base 421*a* is attached to the first end portion 41*a* of the ankle cap 41. The lever 421*c* is pivotally attached to the support base 421*a* through a pin 421*g*. The traction element 421*e* is pivotally attached to the lever 421*c* through a pin 421*h*. In the illustrated example, the traction element 421*e* includes a rod 421*m* and a housing 421*n*. The rod 421*m* of the traction element 421*e* can be rotated into and out of the housing 421*n* to adjust the length of the traction element 421*e*. Thus, the connection tightness of the ankle cap assembly 40 (and the toe cap assembly 50) can be adjusted by adjusting the length of the traction element 421*e*. In some embodiments, the rod 421*m* of the traction element 421*e* may not be adjustable. The buckle mechanism 42 (and the toe cap buckle mechanism 52) is generally similar in construction and operation to buckle mechanisms used on conventional ski boots except for the binding hook 426.

The first engagement member 424 is connected to the first buckle 421. Specifically, the first engagement member 424 is pivotally connected to the traction element 421*e* of the first buckle 421 through a pin 428. The first engagement member 424 can be made of metal, plastic or other suitable material. The first engagement member 424 has an opening 424*a*. Though FIG. 6 shows an example in which the opening 424*a* is rectangular, the shape of the opening 424*a* is not limited to rectangular. The first engagement member 424 includes an engagement portion 424*c*, for example a pin or bar, that is engageable with the first binding hook 426. The engagement portion 424*c* defines a part of the opening 424*a*.

The first binding hook 426 is attached on the binding frame 1. In this embodiment, the first binding hook 426 is non-rotatably attached to the binding frame 1 by the attaching member 7A at a location to be engageable with the first engagement member 424. The first binding hook 426 can be made of metal, plastic or other suitable material.

As shown in FIG. 6, the first binding hook 426 includes a first base part 426*a* and a first receiving part 426*c*. The first base part 426*a* is attached to the binding frame 1 by the attaching member 7A. The first base part 426*a* directly contacts the first side surface 11 of the binding frame 1. The first receiving part 426*c* is integrally formed on the first base part 426*a*. The first receiving part 426*c* receives a part of the first engagement member 424 (specifically, the engagement portion 424*c*), when the first binding hook 426 is engaged with the first engagement member 424. The first receiving part 426*c* directly contacts the engagement portion 424*c* of the first engagement member 424 when the first binding hook 426 is engaged with the first engagement member 424. The first receiving part 426*c* is disposed in the opening 424*a* of the first engagement member 424 when the first binding hook 426 is engaged with the first engagement member 424. As shown in FIG. 6, the first receiving part 426*c* overlaps the binding frame 1 in a side view. The first receiving part 426*c* includes a portion located below the upper edge 15. In the illustrated example, a part of the first receiving part 426*c* is located above the upper edge 15. However, the entirety of the first receiving part 426*c* may be located below the upper edge 15. In some embodiments, the first binding hook 426 may include a plurality of first receiving parts to adjust the ankle cap 41 relative to the binding frame 1.

In some embodiments, there can be a plurality, for example two, of the first binding hooks 426 on each binding B1, each of which can include a first receiving part 426*c*. In the case of two first binding hooks 426, the first binding hooks 426 can be arranged serially/linearly so that one of the binding hooks 426 is disposed between the other binding hook 426 and the attaching member 7A, or the binding hooks 426 can be arranged side-by-side so they are generally equally spaced from the attaching member 7A. When the binding hooks 426 are arranged serially/linearly, the engagement member 424 can engage with either one of the binding hooks 426 so as to be selectively engaged by the user with either of the hooks 426 to add an additional tightness adjustment option.

In another embodiment, the first engagement member 424 can include a plurality, for example two, of the engagement portions 424*c*. In the case of two of the engagement portions 424*c* and two of the binding hooks 426, the engagement portions 424*c* can be arranged serially/linearly so that one of the engagement portions 424*c* is disposed between the other engagement portion 424*c* and the traction element 421*e*, or the engagement portions 424*c* can be arranged side-by-side so they are generally equally spaced from the traction element 421*e*. When the engagement portions 424*c* are arranged serially/linearly, each one of the engagement portions 424*c* can engage with one of the binding hooks 426 at the same time.

As shown in FIG. 5, the ankle cap strap 43 is attached to the binding frame 1, and to the ankle cap 41. Specifically, the ankle cap strap 43 is attached to the second side surface 12 of the binding frame 1 by the attaching member 7B. In addition, the ankle cap strap 43 can be attached to the second end portion 41*b* of the ankle cap 41, for example by two attaching members 7D. The two attaching members 7D can be, for example, quick adjust screws. The ankle cap strap 43 can also include a plurality of adjustment holes 432 formed therein that are engageable with the attaching members 7D to adjust the ankle cap 41 relative to the binding frame 1. The ankle cap strap 43 can be formed of any materials that are suitable for performing the functions of the ankle cap strap 43, for example plastic, carbon fiber, or kevlar. In one embodiment, the ankle cap strap 43 may include one or more thin metal cables coated in rubber/plastic so as not to wear into the boot. In another embodiment, the strap 43 (and/or the strap 53 described below) could be replaced with a buckle mechanism similar to the buckle mechanism 42 (and/or the buckle mechanism 52 described below).

With reference to FIGS. 2, and 4-6, the toe cap 51 is connected to the binding frame 1. The toe cap 51 helps to hold the snowboard rider's boot to the binding frame 1. The toe cap 51 includes a first end portion 51*a* and a second end portion 51*b*. In the illustrated embodiment, the first end portion 51*a* is disposed at one end of the toe cap 51 in a width direction of the binding frame 1. The second end portion 51*b* is disposed at the other end of the toe cap 51 in the width direction.

The toe cap buckle mechanism 52 connects the toe cap 51 to one side of the binding frame 1. In the illustrated example, the toe cap buckle mechanism 52 is attached to the first end portion 51*a* of the toe cap 51, and is releasably attachable to the first side surface 11 of the binding frame 1. The toe cap buckle mechanism 52 can have two primary conditions—a connected condition and a disconnected condition. When the toe cap buckle mechanism 52 is in the connected condition, the toe cap 51 and the binding frame 1 are connected by the toe cap buckle mechanism 52 (see FIGS. 2, 5, and 6). On the other hand, when the toe cap buckle mechanism 52 is in the disconnected condition, the toe cap 51 and the binding frame 1 are not connected by the toe cap buckle mechanism 52 (see FIG. 14).

The toe cap buckle mechanism 52 includes a second buckle 521 (also referred to as a second buckle means), a second engagement member 524 (also referred to as a second engagement means), and a second binding hook 526 (also referred to as a second binding hook means).

The second buckle 521 is attached to the toe cap 51. Specifically, the second buckle 521 is attached to the first end portion 51*a* of the toe cap 51. The second buckle 521 can be made of metal, plastic or other suitable material. The second buckle 521 includes a support base 521*a*, a lever 521*c*, and a traction element 521*e*.

As shown in FIGS. 4, and 6, the support base 521*a* is attached to the first end portion 51*a* of the toe cap 51. The lever 521*c* is pivotally attached to the support base 521*a* through a pin 521*g*. The traction element 521*e* is pivotally attached to the lever 521*c* through a pin 521*h*. In the illustrated example, the traction element 521*e* includes a rod 521*m* and a housing 521*n*. The rod 521*m* of the traction element 521*e* can be rotated into and out of the housing 521*n* to adjust the length of the traction element 421*e*. Thus, the connection tightness of the toe cap assembly 50 can be adjusted by adjusting the length of the traction element 421*e*. In some embodiments, the rod 521*m* of the traction element 521*e* may not be adjustable. As indicated above, the buckle mechanism 52 is generally similar in construction and operation to buckle mechanisms used on conventional ski boots except for the binding hook 526.

The second engagement member 524 is connected to the second buckle 521. Specifically, the second engagement member 524 is pivotally connected to the traction element 521*e* of the second buckle 521 through a pin 528. The second engagement member 524 can be made of metal, plastic or other suitable material. The second engagement member 524 has an opening 524*a*. Though FIG. 6 shows an example in which the opening 524*a* is rectangular, the shape of opening 524*a* is not limited to rectangular. The second engagement member 524 includes an engagement portion 524*c*, for example a pin or bar, that is engageable with the second binding hook 526. The engagement portion 524*c* defines a part of the opening 524*a*.

The second binding hook 526 is attached on the binding frame 1. In this embodiment, the second binding hook 526 is non-rotatably attached to the binding frame 1 by an attaching member 7C at a location to be engageable with the second engagement member 524. The second binding hook 526 can be made of metal, plastic or other suitable material.

As shown in FIG. 6, the second binding hook 526 includes a second base part 526*a* and a second receiving part 526*c*. The second base part 526*a* is attached to the binding frame 1 by the attaching member 7C. The second base part 526*a* directly contacts the first side surface 11 of the binding frame 1. The second receiving part 526*c* is integrally formed on the second base part 526*a*. The second receiving part 526*c* receives a part of the second engagement member 524 (specifically, the engagement portion 524*c*) when the second binding hook 526 is engaged with the second engagement member 524. The second receiving part 526*c* directly contacts the engagement portion 524*c* of the second engagement member 524 when the second binding hook 526 is engaged with the second engagement member 524. The second receiving part 526*c* is disposed in the opening 524*a* of the second engagement member 524, when the second binding hook 526 is engaged with the second engagement member 524. As shown in FIG. 6, the second receiving part 526*c* overlaps the binding frame 1 in a side view. The second receiving part 526*c* includes a portion located below or flush with the upper edge 15. In this illustrated example, the entirety of the second receiving part 526*c* is located below or flush with the upper edge 15. However, in other embodiments, a portion of the second receiving part 526*c* may be located above the upper edge 15. In some embodiments, the second binding hook 526 may include a plurality of second receiving parts to adjust the ankle cap 41 relative to the binding frame 1.

In some embodiments, like with the first binding hook 426 and the first engagement member 424, there can be a plurality, for example two, of the second binding hooks 526, and also a plurality, for example two, of the engagement portions 524*c*. The plurality of the second binding hooks 526 and the plurality of the second engagement portions 524*c* can be arranged and function like described above for the first binding hooks 426 and the first engagement members 424.

As shown in FIG. 5, the toe cap strap 53 is attached to the binding frame 1, and to the toe cap 51. Specifically, the toe cap strap 53 is attached to the second side surface 12 of the binding frame 1 by one of the attaching members 7C. The attaching member 7C can be, for example, a quick adjust screw. In addition, the toe cap strap 53 can be attached to the second end portion 51*b* of the toe cap 51 by two attaching members 7C. The two attaching members can be, for example, quick adjust screws. The toe cap strap 53 can also include a plurality of adjustment holes 532 formed therein that are engageable with the attaching members to adjust the toe cap 51 relative to the binding frame 1. The toe cap strap 53 can be formed of any materials that are suitable for performing the functions of the toe cap strap 53, for example plastic. The toe cap strap 53 may include two thin metal cables coated in rubber/plastic so as not to wear into the boot.

As shown in FIG. 1, the snowboard body B2 includes an upper surface 81 and a lower surface 82. The upper surface 81 and the lower surface 82 can be generally flat. However, opposite ends 83, 84 of the snowboard can be curved upwardly in conventional manner. In the snowboard A1, the snowboard bindings B1 are attached to the upper surface 81. Specifically, each binding frame 1 of the snowboard bindings B1 is attached to the upper surface 81 via the base plate 3. For this purpose, in the illustrated example, each base plate 3 of the snowboard bindings B1 is attached to the upper surface 81 by a plurality of attaching members (not shown) in a conventional manner.

The operation of the snowboard A1 and the snowboard bindings B1 should be readily apparent to a person of skill in the art from the foregoing description and the drawings. However, an example use of the snowboard bindings B1 is briefly explained below.

Figure 13:
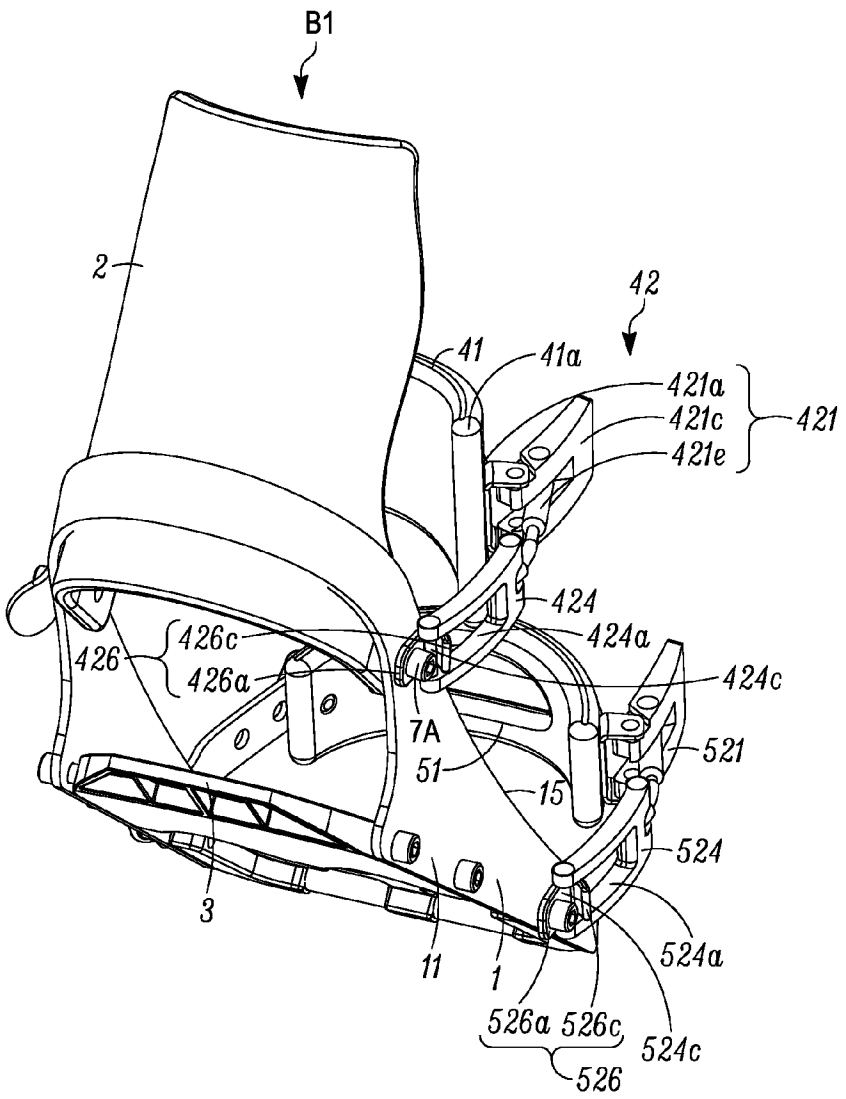
FIG. 13 is a rear perspective view showing a first stage of connection of the snowboard binding according to one embodiment.

With the buckle mechanisms 42, 52 initially disconnected from the hooks 426, 526, the user moves the assemblies 40, 50 out of the way and steps into the binding frames 1. When the user's boots are properly positioned in the binding frames 1, the user pulls the assemblies 40, 50 over the boots and pivots the levers 421*c*, 521*c* upward to the position shown in FIG. 13. At the same time, the engagement portions 424*c*, 524*c* are positioned near the binding hooks 426, 526.

Figure 14:
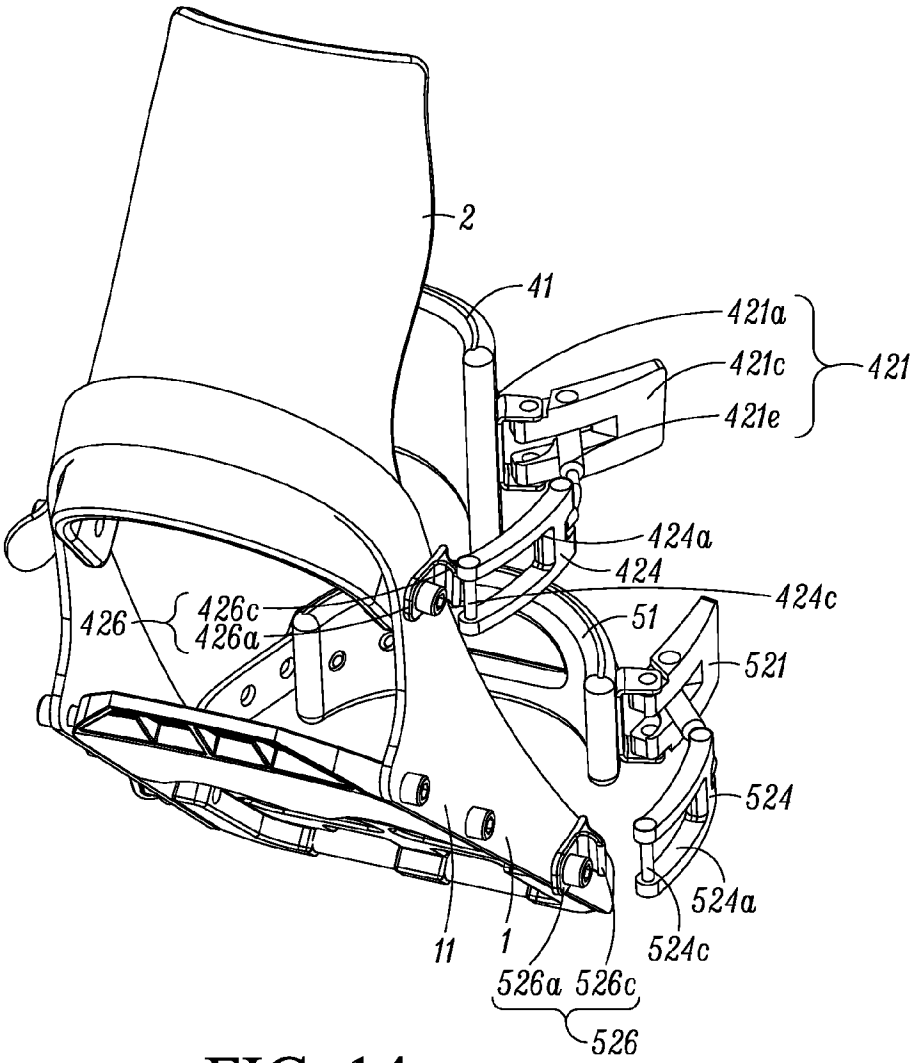
FIG. 14 is a rear perspective view showing a second stage of connection of the snowboard binding according to one embodiment.

Referring to FIG. 14, the engagement portions 424*c*, 524*c* are then maneuvered behind the receiving parts 426*c*, 526*c*. The levers 421*c*, 521*c* are then rotated toward the closed position. As the levers 421*c*, 521*c* are rotated, they pull the traction elements 421*e*, 521*e* which in turn pull the engagement members 424, 524 so that the engagement portions 424*c*, 524*c* gradually become locked behind the receiving parts 426*c*, 526*c* of the binding hooks 426, 526. The levers 421*c*, 521*c* continue to be rotated until they are fully closed (shown in FIGS. 2-4 and 6) and the engagement members 424, 524 are locked to the binding hooks 426, 526. Removal works in an opposite manner, with the levers 421*c*, 52*c* manually rotated to the open position shown in FIG. 13 which frees the engagement portions 424*c*, 524*c* from the receiving parts 426*c*, 526*c*.

The described bindings permit connection of the engagement members to the binding hooks using one hand instead of requiring both hands. In addition, the described bindings have only two straps on each binding instead of four straps. Further, the user can pre-adjust the straps 43, 53 and the traction elements 421*e*, 521*e* to obtain the desired tightness. Thereafter, each time that the user fastens the bindings, the same level of tightness can be achieved without requiring the user to adjust each time the user connects to the bindings. Further, because the engagement members are received by the receiving part of the binding hooks, ice and snow are prevented from building up in the binding hooks. Further, the binding hooks are non-rotatably attached to the binding frame. As a result, the snowboard A1 can respond instantly to the rider's movement (for example when ollieing and spinning or applying nose or tail pressure) and extra delay of the movement of the snowboard A1 that can be caused by pivotally mounted straps can be prevented.

Figure 15:
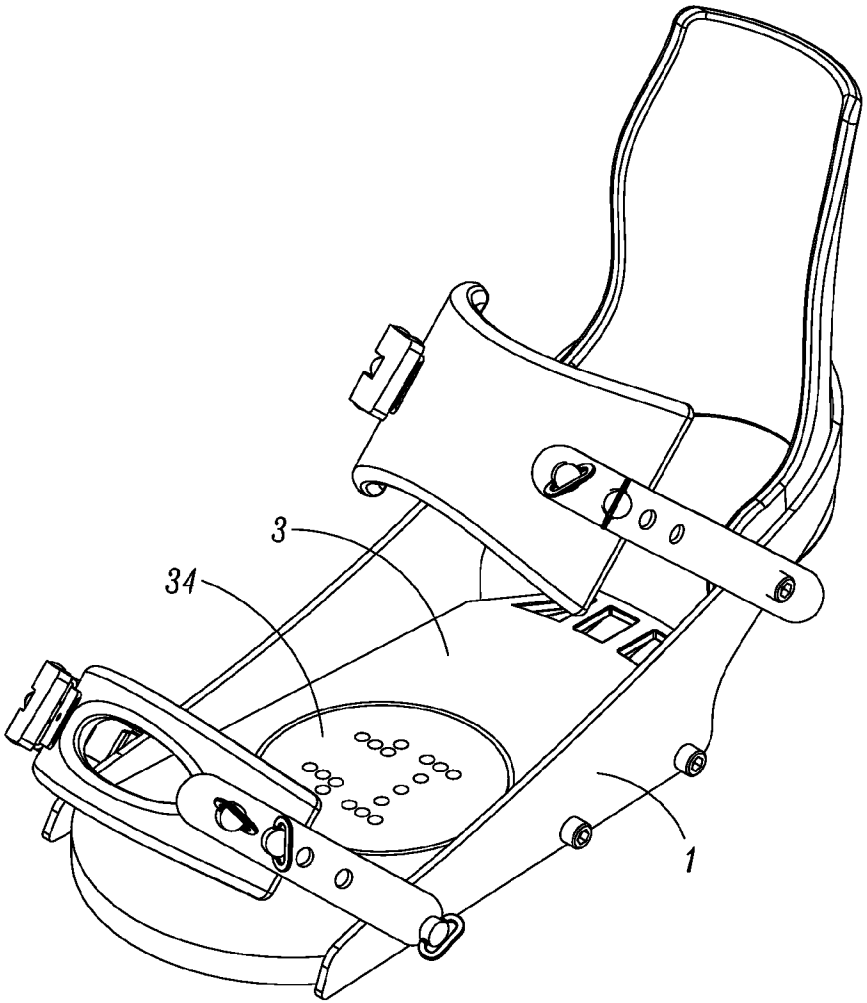
FIG. 15 is a front perspective view showing a snowboard binding according to another embodiment.

FIG. 15 is a front perspective view showing a snowboard binding according to another embodiment.

The snowboard binding shown in FIG. 15 is different from the snowboard binding shown in FIG. 4 in that a puck or circular disk 34 is mounted on the base plate 3. Other structures in the snowboard binding in FIG. 15 are the same as the foregoing embodiment in FIGS. 1-14. The puck 34 shown in FIG. 15 is a circular plate and can be used for adjusting an angle of the binding frame 1 on the snowboard body. For example, once the user loosens screws (not shown) that fix the puck 34 to the snowboard body, the user can rotate the binding frame 1 relative to the puck 34. Once the desired angle of the binding frame 1 is achieved, the user then tightens the screws of the puck 34 which clamps the base plate 3 and fixes the position of the binding frame 1. The construction and operation of a binding frame with a puck-like disc permitting adjustment of the binding frame is known in the art.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A snowboard binding comprising:

a binding frame;

an ankle cap connected to the binding frame;

a first buckle pivotally attached to the ankle cap for pivoting movement relative to the ankle cap between a first open position and a first closed position;

a first engagement member connected to the first buckle so as to be movable with the first buckle when the first buckle pivots between the first open position and the first closed position, the first engagement member having a first disconnect position when the first buckle is at the first open position and a first connect position when the first buckle is at the first closed position, and the first engagement member is positioned closer to the ankle cap at the first connect position than when the first engagement member is at the first disconnect position;

a first binding hook directly attached to the binding frame and releasably engageable with the first engagement member;

a toe cap connected to the binding frame;

a second buckle pivotally attached to the toe cap for pivoting movement relative to the toe cap between a second open position and a second closed position;

a second engagement member connected to the second buckle so as to be movable with the second buckle when the second buckle pivots between the second open position and the second closed position, the second engagement member having a second disconnect position when the second buckle is at the second open position and a second connect position when the second buckle is at the second closed position, and the second engagement member is positioned closer to the toe cap at the second connect position than when the second engagement member is at the second disconnect position; and a second binding hook directly attached to the binding frame and releasably engageable with the second engagement member.

2. The snowboard binding of claim 1, wherein each of the first binding hook and the second binding hook includes a receiving part, the receiving part of the first binding hook receives a part of the first engagement member when the first binding hook is engaged with the first engagement member, the receiving part of the second binding hook receives a part of the second engagement member when the second binding hook is engaged with the second engagement member, and each of the receiving parts overlaps the binding frame in a side view.

3. The snowboard binding of claim 2, wherein the binding frame includes an upper edge, and each of the receiving parts includes a portion located below the upper edge.

4. The snowboard binding of claim 1, further comprising:

an ankle cap strap attached to the binding frame; and a toe cap strap attached to the binding frame, wherein each of the ankle cap and the toe cap includes a first end portion and a second end portion, the first buckle is attached to the first end portion of the ankle cap, and the ankle cap strap is attached to the second end portion of the ankle cap, and the second buckle is attached to the first end portion of the toe cap, and the toe cap strap is attached to the second end portion of the toe cap.

5. The snowboard binding of claim 1, further comprising:

an attaching member attaching the first binding hook to the binding frame; and a highback pivotally attached to the binding frame by the attaching member.

6. The snowboard binding of claim 1, wherein the binding frame includes two outwardly facing side surfaces, each of the first binding hook and the second binding hook are attached to a single one of the two outwardly facing side surfaces.

7. The snowboard binding of claim 1, wherein each of the first engagement member, the first binding hook, the second engagement member, and the second binding hook is made of metal or plastic.

8. A snowboard comprising:

two of the snowboard bindings of claim 1; and a snowboard body, wherein the snowboard body comprises an upper surface and a lower surface opposite the upper surface, and the two snowboard bindings are attached to the upper surface.

9. A snowboard binding comprising:

a binding frame;

an ankle cap connected to the binding frame;

an ankle cap strap attached to the binding frame and to the ankle cap;

an ankle cap buckle mechanism connecting the ankle cap and the binding frame, the ankle cap buckle mechanism includes a first buckle, a first engagement member, and a first binding hook; the first buckle and the first engagement member are mounted on the ankle cap, and the first binding hook is mounted on the binding frame and is releasably engageable with the first engagement member;

the first buckle is pivotally mounted to the ankle cap for pivoting movement relative to the ankle cap between a first open position and a first closed position;

the first engagement member is connected to the first buckle so as to be movable with the first buckle when the first buckle pivots between the first open position and the first closed position, the first engagement member having a first disconnect position when the first buckle is at the first open position and a first connect position engaged with the first binding hook when the first buckle is at the first closed position, and the first engagement member is positioned closer to the ankle cap at the first connect position than when the first engagement member is at the first disconnect position;

a toe cap connected to the binding frame;

a toe cap strap attached to the binding frame and to the toe cap;

a toe cap buckle mechanism connecting the toe cap and the binding frame, the toe cap buckle mechanism includes a second buckle, a second engagement member, and a second binding hook; the second buckle and the second engagement member are mounted on the toe cap, and the second binding hook is mounted on the binding frame and is releasably engageable with the second engagement member;

the second buckle is pivotally attached to the toe cap for pivoting movement relative to the toe cap between a second open position and a second closed position; and the second engagement member is connected to the second buckle so as to be movable with the second buckle when the second buckle pivots between the second open position and the second closed position, the second engagement member having a second disconnect position when the second buckle is at the second open position and a second connect position engaged with the second binding hook when the second buckle is at the second closed position, and the second engagement member is positioned closer to the toe cap at the second connect position than when the second engagement member is at the second disconnect position.

10. The snowboard binding of claim 9, wherein each of the first binding hook and the second binding hook includes a receiving part, the receiving part of the first binding hook receives a part of the first engagement member when the first binding hook is engaged with the first engagement member, the receiving part of the second binding hook receives a part of the second engagement member when the second binding hook is engaged with the second engagement member, and each of the receiving parts overlaps the binding frame in a side view.

11. The snowboard binding of claim 10, wherein the binding frame includes an upper edge, and each of the receiving parts includes a portion located below the upper edge.

12. The snowboard binding of claim 9, wherein each of the ankle cap and the toe cap includes a first end portion and a second end portion, the first buckle is attached to the first end portion of the ankle cap, and the ankle cap strap is attached to the second end portion of the ankle cap, and the second buckle is attached to the first end portion of the toe cap, and the toe cap strap is attached to the second end portion of the toe cap.

13. The snowboard binding of claim 9, further comprising:

an attaching member attaching the first binding hook to the binding frame; and a highback pivotally attached to the binding frame by the attaching member.

14. The snowboard binding of claim 9, wherein the binding frame includes two outwardly facing side surfaces, and each of the first binding hook and the second binding hook are attached to a single one of the two outwardly facing side surfaces.

15. The snowboard binding of claim 9, wherein each of the first engagement member, the first binding hook, the second engagement member, and the second binding hook is made of metal or plastic.

16. A snowboard comprising:

two of the snowboard bindings of claim 9; and a snowboard body, wherein the snowboard body comprises an upper surface and a lower surface opposite the upper surface, and the two snowboard bindings are attached to the upper surface.

17. A snowboard binding comprising:

a binding frame means;

an ankle cap assembly that includes an ankle cap means connected to the binding frame means, a first buckle means attached to the ankle cap means, a first engagement means connected to the first buckle means, and a first binding hook means that is releasably engageable with the first engagement means; the first binding hook means is mounted directly on an outwardly facing side surface of the binding frame means;

the first buckle means is pivotally mounted to the ankle cap means for pivoting movement relative to the ankle cap means between a first open position and a first closed position;

the first engagement means is connected to the first buckle means so as to be movable with the first buckle means when the first buckle means pivots between the first open position and the first closed position, the first engagement means having a first disconnect position when the first buckle means is at the first open position and a first connect position when the first buckle means is at the first closed position;

a toe cap assembly that includes a toe cap means connected to the binding frame means, a second buckle means attached to the toe cap means, a second engagement means connected to the second buckle means, and a second binding hook means that is releasably engageable with the second engagement means; the second binding hook means is mounted directly on the outwardly facing surface of the binding frame means;

the second buckle means is pivotally attached to the toe cap means for pivoting movement relative to the toe cap means between a second open position and a second closed position; and the second engagement means is connected to the second buckle means so as to be movable with the second buckle means when the second buckle means pivots between the second open position and the second closed position, the second engagement means having a second disconnect position when the second buckle means is at the second open position and a second connect position when the second buckle means is at the second closed position.

18. The snowboard binding of claim 17, wherein each of the ankle cap means and the toe cap means includes a first end portion and a second end portion;

a first strap connecting the first end portion of the ankle cap means to the binding frame means;

a second strap connecting the first end portion of the toe cap means to the binding frame means; and the second end portion of the ankle cap means and the second end portion of the toe cap means are not connected to the binding frame by straps.

* * * * *